US005423301A

United States Patent [19]

Bissett et al.

[11] Patent Number: 5,423,301

[45] Date of Patent: Jun. 13, 1995

[54] TIMING CONTROL VALVE FOR HYDROMECHANICAL FUEL SYSTEM

[75] Inventors: Travis A. Bissett, Columbus, Ind.; Stuart Morris, Northamptonshire, United Kingdom

[73] Assignee: Cummins Engine Company, Inc., Columbus, Ind.

[21] Appl. No.: 197,832

[22] Filed: Feb. 17, 1994

[51] Int. Cl.[6] ..... F02M 37/04; F02M 7/00

[52] U.S. Cl. ..... 123/446; 123/502

[58] Field of Search ..... 123/446, 457, 500, 501, 123/502, 503, 504, 456

[56] References Cited

U.S. PATENT DOCUMENTS

| | | | |
|---|---|---|---|
| 3,486,492 | 12/1969 | Lehnerer . | |
| 3,598,097 | 8/1971 | Eheim . | |
| 4,281,792 | 8/1981 | Sisson et al. | 123/502 |
| 4,396,151 | 8/1983 | Kato et al. | 123/502 |
| 4,407,250 | 10/1983 | Eheim et al. | 123/502 |
| 4,408,591 | 10/1983 | Nakamura . | |
| 4,621,605 | 11/1986 | Carey, Jr. et al. | 123/502 |
| 4,721,247 | 1/1988 | Perr . | |
| 4,869,219 | 9/1989 | Bremmer et al. . | |
| 4,909,219 | 3/1990 | Perr et al. . | |
| 4,971,016 | 11/1990 | Peters et al. | 123/446 |
| 4,986,472 | 1/1991 | Warlick et al. . | |
| 5,042,445 | 8/1991 | Peters et al. | 123/446 |
| 5,056,488 | 10/1991 | Eckert | 123/446 |
| 5,277,162 | 1/1994 | Smith et al. | 123/456 |

OTHER PUBLICATIONS

Cummins Engine Co., Inc. Bulletin No. 3379294, Entitled PT (Type H) AFC-VS Fuel Pump and Fuel Flow Mar. 1979.

*Primary Examiner*—Raymond A. Nelli
*Assistant Examiner*—Thomas N. Moulis
*Attorney, Agent, or Firm*—Sixbey, Friedman, Leedom & Ferguson

[57] ABSTRACT

An infinitely variable hydromechanical timing valve, for a fuel supply system for an internal combustion engine, is provided with a housing having a valve seat therein, and a timing control plunger mounted for reciprocation within the housing toward and away from the valve seat. A first side of the timing control plunger is acted upon by a pressure which varies as a function of engine load while a second side of the timing control plunger is acted upon by a pressure which varies as a function of engine speed. Furthermore, the timing control plunger has an orificed flow passage therethrough, one end of which is in communication with a timing flow of fuel from the pump and an opposite end of which timing flow passage communicates with a timing fluid supply rail. As a result, a variable flow area is defined by the circumference of the orifice of the orificed flow passage through the plunger and the distance of the orifice from the valve seat as a means for controlling the pressure of the timing flow communicated to the timing fluid supply rail by a throttling of the timing flow from the pump in a manner which is a function of the pressures acting on the timing control plunger. The pressure of the timing flow from the valve can be controlled in accordance with either a fixed or variable ratio between it and the speed responsive pressure acting on the timing plunger.

17 Claims, 6 Drawing Sheets

TIMING CONTROL VALVE FOR HYDROMECHANICAL FUEL SYSTEM

BACKGROUND OF THE INVENTION

1. Field of the Invention

The present invention relates generally to controls for fuel injection systems for internal combustion engines. More specifically, the invention relates to a timing control for regulating injection timing in fuel injectors for compression ignition type internal combustion engines, especially wherein fuel is supplied to unit fuel injectors which operate on a pressure-time metering principle via a hydromechanical fuel system.

2. Background Art

Unit fuel injectors which operate on a pressure-time metering principle have been in use for some time now (see U.S. Pat. Nos. 4,721,247; 4,986,472 and the patents mentioned therein), and have contributed greatly to the ability of internal combustion engine designers to meet the ever increasing demands for improved pollution control and increased fuel economy. In fuel supply systems using such injectors, fuel is supplied by a gear pump to all of the injectors via a fuel rail and the same is true for timing fluid used to control the degree that the timing of the injection event is advanced or retarded, with the quantity of fuel and timing fluid delivered to each injector being a function of the supply pressure from the common rail and the time period during which the metering and timing chambers are in communication with the respective supply rails. Examples of gear pump type fuel supply systems for P-T type unit fuel injectors can be found in U.S. Pat. Nos. 4,909,219 and 5,042,445 as well as in Cummins Engine Company's Bulletin No. 337929401 which illustrates a PT type H automatic fuel controller.

However, for the continuing demands for improved pollution control and increased fuel economy to be met, it becomes increasingly essential to be able to optimize the combustion process, not only by precisely controlling the quantity of fuel injected into each cylinder, but also by precisely regulating the timing thereof, and this has become increasingly more difficult as the level of combustion efficiency to be obtained is raised. Ultimately, increased precision means that the controller must be infinitely variable as well as responsive to the various parameters affecting fuel quantity and timing.

U.S. Pat. No. 4,869,219 discloses an air fuel control for P-T fuel systems which uses a diaphragm-type operator to provide a controlled, optimum amount of fuel as a function of intake manifold pressure, and which can be retrofit installed on previously existing engines. However, no equivalent control for regulating engine timing is provided.

U.S. Pat. Nos. 3,486,492 and 4,408,591 show fuel injection pumps which have a built-in timing control which can delay advancing of injection timing upon acceleration. However, these disclosures relate to distributor-type pumps not gear pumps, and are not adapted to the needs of P-T fuel injectors and the fuel systems therefor. Likewise, U.S. Pat. No. 3,598,097 discloses a hydraulic regulator system for fuel injection pumps in which a pressure control valve is provided having a spring-loaded piston which responds to changes in the pressure of fuel supplied from a gear pump to adjust the flow of the fuel which acts on an injection timer setting member by varying the extent to which a port is block and unblocked by the spring-loaded piston. However, this system does not control timing fluid flow as a function of pressure in a metering rail for supplying fuel for injection, and in general, also, is not adapted to the needs of P-T fuel injectors and the fuel systems therefor.

In commonly owned, U.S. patent application Ser. No. 08/007,973, now U.S. Pat. No. 5,277,162, an infinitely variable hydromechanical timing valve that can precisely regulate engine timing as a function of engine speed and load conditions is described. This timing valve is a spool-type hydromechanical timing valve and is provided with a valve body assembly having a barrel and plunger arrangement. The plunger is displaceable within the barrel under the counterbalancing forces of rail fuel pressure (load) and one or more timing valve springs. The relative position of the barrel and plunger determines the effective size of the port through which timing fluid can flow. For example, in accordance with a first embodiment, the plunger has a tapered head which covers and uncovers ports in the barrel to a greater or lesser extent, thereby creating a variable flow-through cross section. Alternatively, in accordance with other embodiments, the barrel has ports with slot-like orifices of progressively changing widths which coact with a metering groove on the plunger to define a variable flow cross section through which the timing fluid must pass.

While the system of this prior application has many advantages, it has many critical dimensions due to the complex shape of the metering port and metering groove plunger. Furthermore, such a system would likely require a family of assemblies to address a wide range of engine types and ratings. This is because the port and reference springs produce a valve restriction that is a particular function of rail pressure, and a function that is appropriate for one engine application is easily inappropriate for a widely different engine application.

SUMMARY OF THE INVENTION

In view of the foregoing, it is a general object of the present invention to provide a timing control valve for a hydromechanical fuel system that can precisely regulate engine timing as a function of engine speed and load conditions.

It is a more specific object of the present invention to provide a timing control valve which will have few critical dimensions and ports and which will avoid the need for a family of assemblies to address a wide range of engine types and ratings.

Another object of the invention is to provide a timing control valve which will deliver a timing pressure output as a function of pump pressure and metering rail pressure so as to sustain timing pressure in a set ratio to pump pressure.

A more specific object of the invention is to provide a timing control valve that utilizes a variable flow area defined by the circumference of the plunger orifice and the distance of the nozzle from a seat to control timing flow pressure by a throttling of the flow in a manner which is a function of metering rail pressure.

In accordance with preferred embodiments of the present invention, these objects and others are provided by an infinitely variable hydromechanical timing valve, for a fuel supply system for an internal combustion engine of the type wherein a supply pump supplies fuel to fuel injectors at a pressure that is controlled in accordance with engine operating conditions via a first supply rail and supplies timing fluid to the fuel injectors via a second supply rail, comprising a housing having a valve seat therein, and a timing control plunger mounted for reciprocation within the housing toward and away from the valve seat. A first side of the timing control plunger is acted upon by a pressure which varies as a function of engine load while a second side of the timing control plunger is acted upon by a pressure which varies as a function of engine speed. Furthermore, the timing control plunger has an orificed flow passage therethrough, one end of which is in communication with a timing flow of fuel from the pump and an opposite end of which timing flow passage communicates with the second supply rail. As a result, a variable flow area is defined by the circumference of the orifice of the orificed flow passage through the plunger and the distance of the orifice from the valve seat as a means for controlling the pressure of the timing flow communicated to the second supply rail by a throttling of the timing flow from the pump in a manner which is a function of the pressures acting on the timing control plunger.

In accordance with a first embodiment, the pressure of the timing flow from the valve is controlled in accordance with a fixed ratio between it and the speed responsive pressure acting on the timing plunger. On the other hand, in accordance with a second embodiment, the pressure of the timing flow from the valve is controlled in accordance with a variable ratio between it and the speed responsive pressure acting on the timing plunger by the provision of a variable orifice arrangement that causes an additional, variable, pressure to act on the timing plunger in the direction of action of the speed-responsive pressure.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
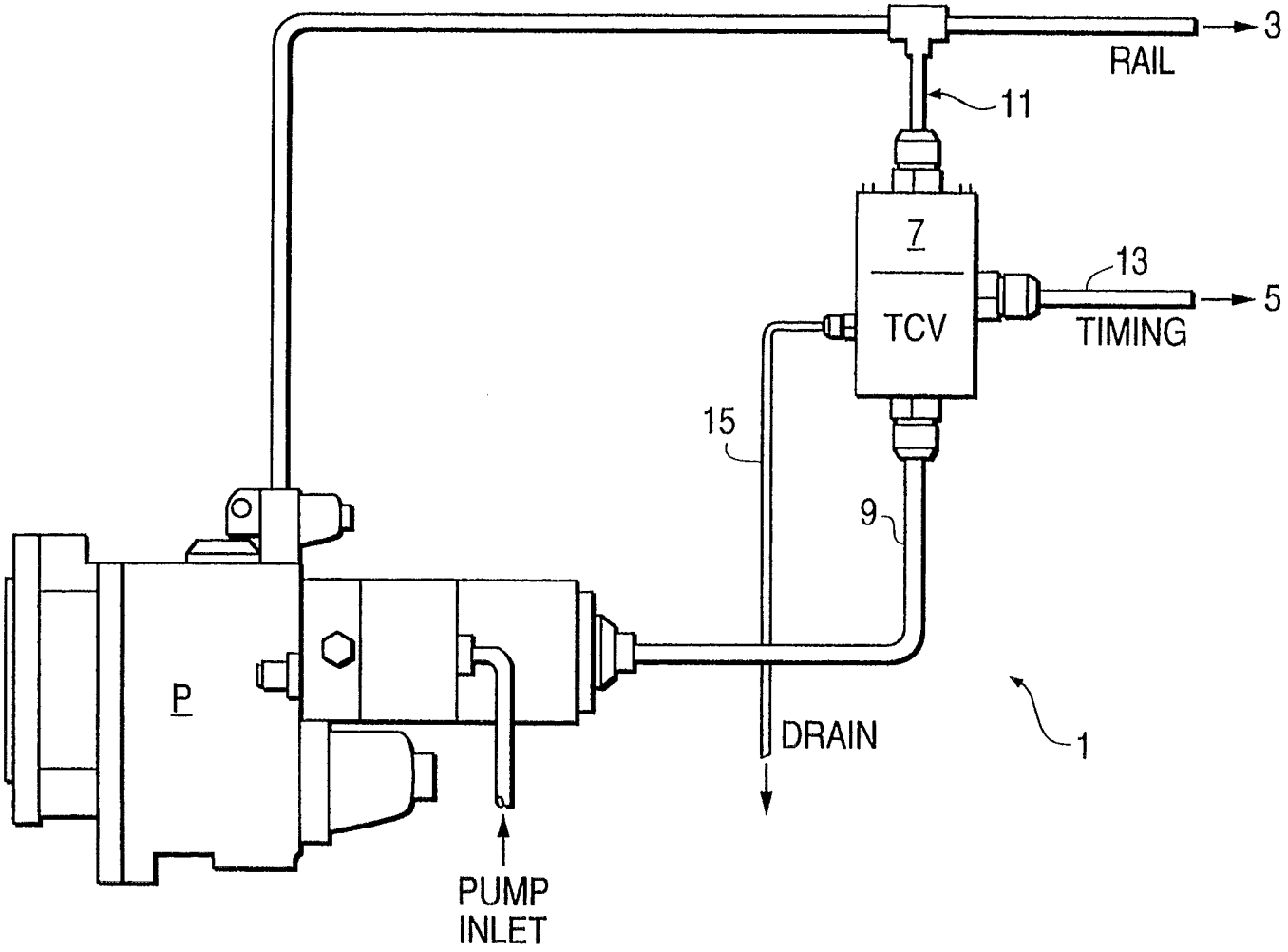
FIG. 1 is a diagrammatic depiction of a fuel supply system incorporating a hydromechanical timing control valve in accordance with the present invention.

FIG. 1 depicts the basic constituents of a fuel supply system 1 for supplying fuel and tinning fluid to the injectors of an internal combustion engine (not shown). This system 1 utilizes a conventional supply pump P to supply fuel from a fuel reservoir (such as a vehicle fuel tank) to all of the injectors at a pressure that is controlled in accordance with engine operating conditions (in a known manner) via a fuel supply rail 3, and to supply timing fluid to all of the injectors via a second supply rail 5. In order to make the supply of timing fluid speed and load responsive, a timing control valve 7 receives fuel at a pressure of the supply pump P which is governed to be engine speed responsive, via a speed-responsive pump pressure rail 9, and is exposed to fuel at the fuel supply pressure of rail 3 (which is engine load responsive) via a fuel pressure line 11. Timing fluid, as regulated by timing control valve 7, is supplied to timing rail 5 via a connector line 13 and leakage is drained from timing control valve 7 via a drain line 15.

In all embodiments of the present invention, the timing control valve 7 is an infinitely variable hydromechanical timing valve. In a first form of the timing valve 7, shown in FIG. 2, a timing plunger 18, having an axial passage 20, is displaceably mounted within a valve housing 22, as is a rail plunger 24. The timing plunger 18 is mounted for reciprocation within the valve housing 22, toward and away from a valve seat 26, by an extent that is controlled by the rail plunger 24. A bias spring 28 (FIG. 3) is disposed in the valve housing 22 so as to act on a first end of the rail plunger 24 and provides compensation for system effects; although, this spring is desirable, it can be eliminated. An opposite, second end of the rail plunger 24 serves as an abutment stop for the timing plunger by engaging an engagement member in the form of a pin 30 which extends diametrally across the interior of timing plunger 18.

The rail plunger 24 is in communication with the fuel supply rail 3 by fuel pressure line 11 being connected to a fuel pressure inlet 22*a* of housing 22. Additionally, the speed-responsive pump pressure rail 9 connects the supply pump P directly to a timing fluid inlet 22*b* of housing 22, the timing fluid, after passing through axial passage 20 of the timing plunger 18, flows to fluid supply rail 5 via the connector line 13 which is connected to a timing fluid outlet 22*c* of the housing 22. Fluid which leaks around the plungers 18, 24 is returned to the reservoir by being directed to a drain outlet 22*d* by a drain path 22*e*. Drain outlet 22d can, optionally, be provided with an orifice 25 (FIG. 3) in order to dampen resonance effects and drain pressure noise.

Figure 2:
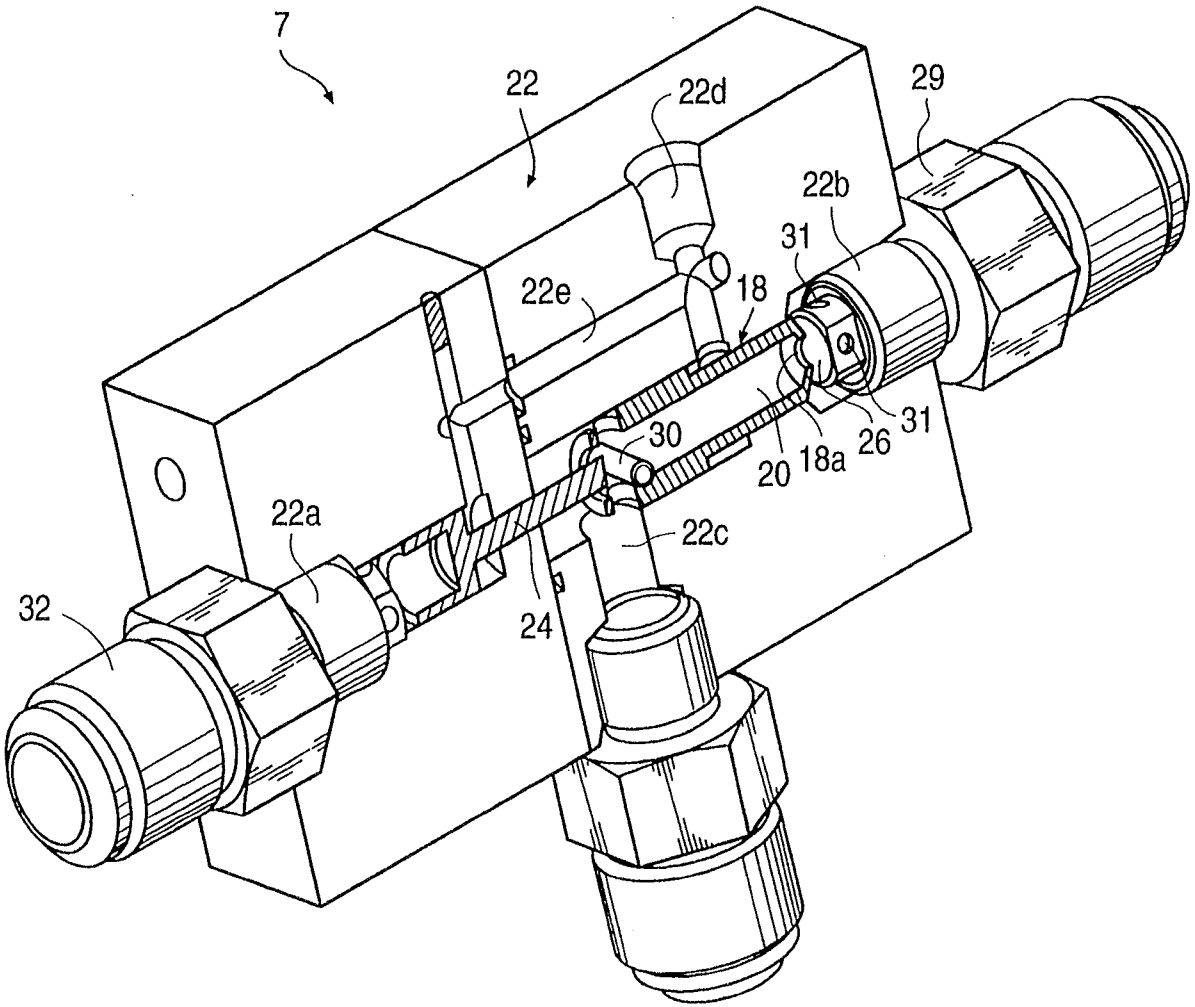
FIG. 2 is a partial cross-sectional view of a timing control valve which operates in accordance with the flow schematic of FIG. 3.

Advantageously, the valve seat 26 is formed as a plug that is inserted in an inner end of the inlet connector 29 for connector line 13, and the fluid flow exits the inlet connector 29 via four radial outlet openings 31 formed in sidewalls of the valve seat 26. As shown in FIG. 2, inlet connector 32 for fuel pressure line 11 is constructed in the same manner as inlet connector 29 and has a similar seat plug mounted therein.

Figure 3:
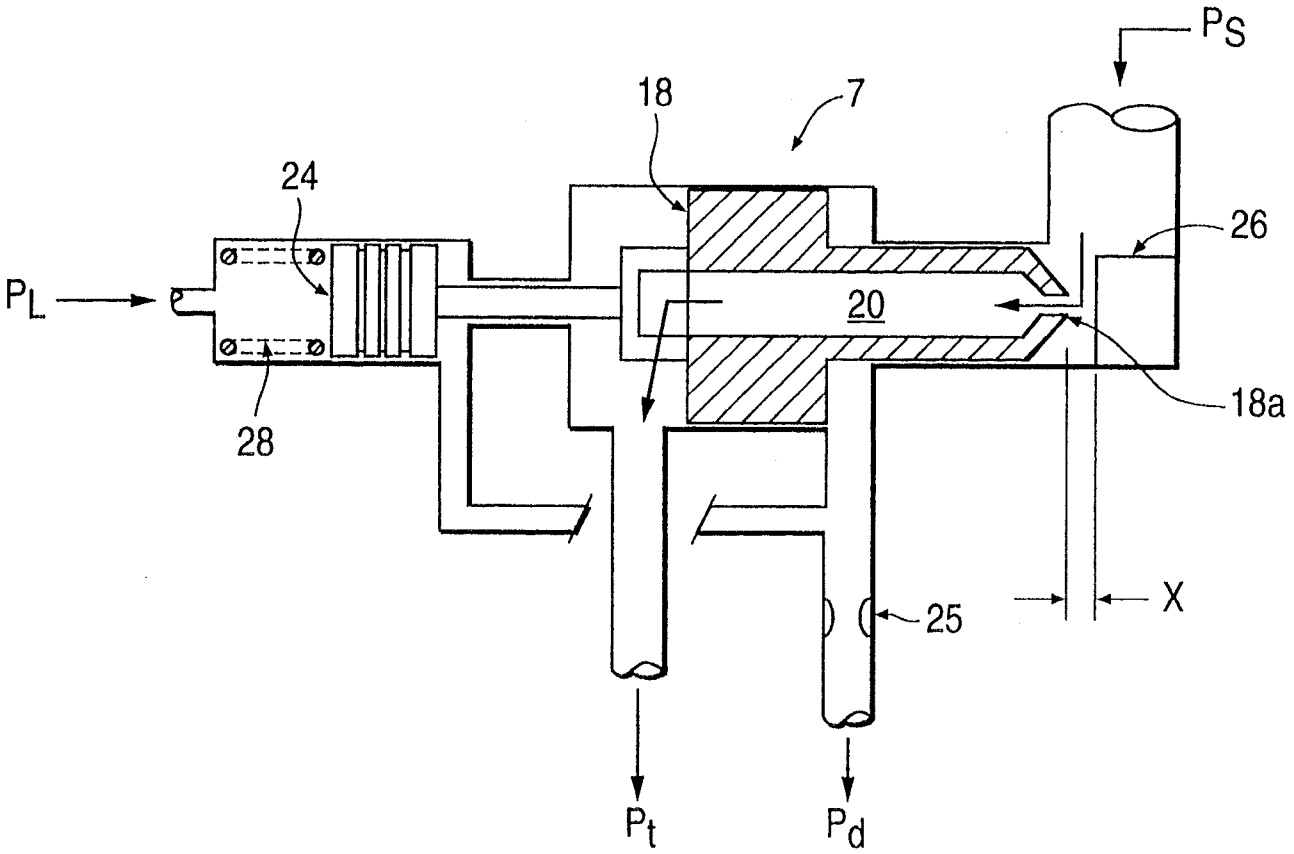
FIG. 3 is a flow schematic of a timing control valve in accordance with the present invention.

With reference to FIG. 3, it can be seen that, as the load-responsive rail pressure $P_L$ increases, rail plunger 24 will act on the timing plunger 18 causing it to move in a direction decreasing the distance x between the end of the timing plunger 18 and the valve seat 26, changing the flow coefficient through the orifice 18*a* in the end of the timing plunger 18 that leads to passage 20. As a result, the timing pressure $P_t$ decreases. This system is designed to be governed by the simple orifice law (wherein flow is proportional to the square root of the pressure drop across the orifice), and on the assumption that the ratio R between the speed-responsive pump pressure $P_s$ and the timing pressure $P_t$ is essentially constant for a particular engine or .family of engines. This ratio can be determined empirically for the particular engine involved, and in the illustrated control valve, is set by selection of the ratio K of the areas of the piston surfaces upon which the pressures $P_L$ and $P_s$ act so that $$P_t = P_d + K(P_s - P_L)$$

Additionally, the size (circumference C) of the orifice opening 18a of plunger 18 is set by choosing a maximum value for x, i.e., $x_{max}$, based, on control valve size considerations, for example, and determining the maximum quantity of timing fluid, $Q_{max}$, which the control valve must be able to deliver to meet the needs for use with a particular engine or family of engines at the expected pressure drop $\Delta P$ through orifice 18a. These values are then applied to the relationships:

$$C = Q_{max}/x_{max}G\sqrt{\Delta P} \text{ and } x_{max} \leqq C/S\pi$$

where G is a coefficient which combines various empirically determined constants such as the specific gravity of the fluid, e.g., diesel fuel, and the coefficient of discharge through orifice 18a, and where S is a control factor on the order of 8–16 which is used to improve the linearity of the response.

For engines which have a limited operating range, such as for generators sets, and where the fuel injectors are properly calibrated, the single ratio system described above can be sufficient, and in other cases, it may be possible to define calibration rules for the pump governor that will produce a torque curve for the pump which will result in a single ratio between the timing pressure and the speed-responsive pump pressure $P_s$. However, for vehicle engines, in practice, a single ratio, most likely, will not apply under both low load and high load conditions. For this reason, the modified system of FIG. 4 is preferred in that it enables, as described below, the ratio between the speed-responsive pump pressure $P_s$ and the timing pressure $P_t$ to be varied.

Figure 4:
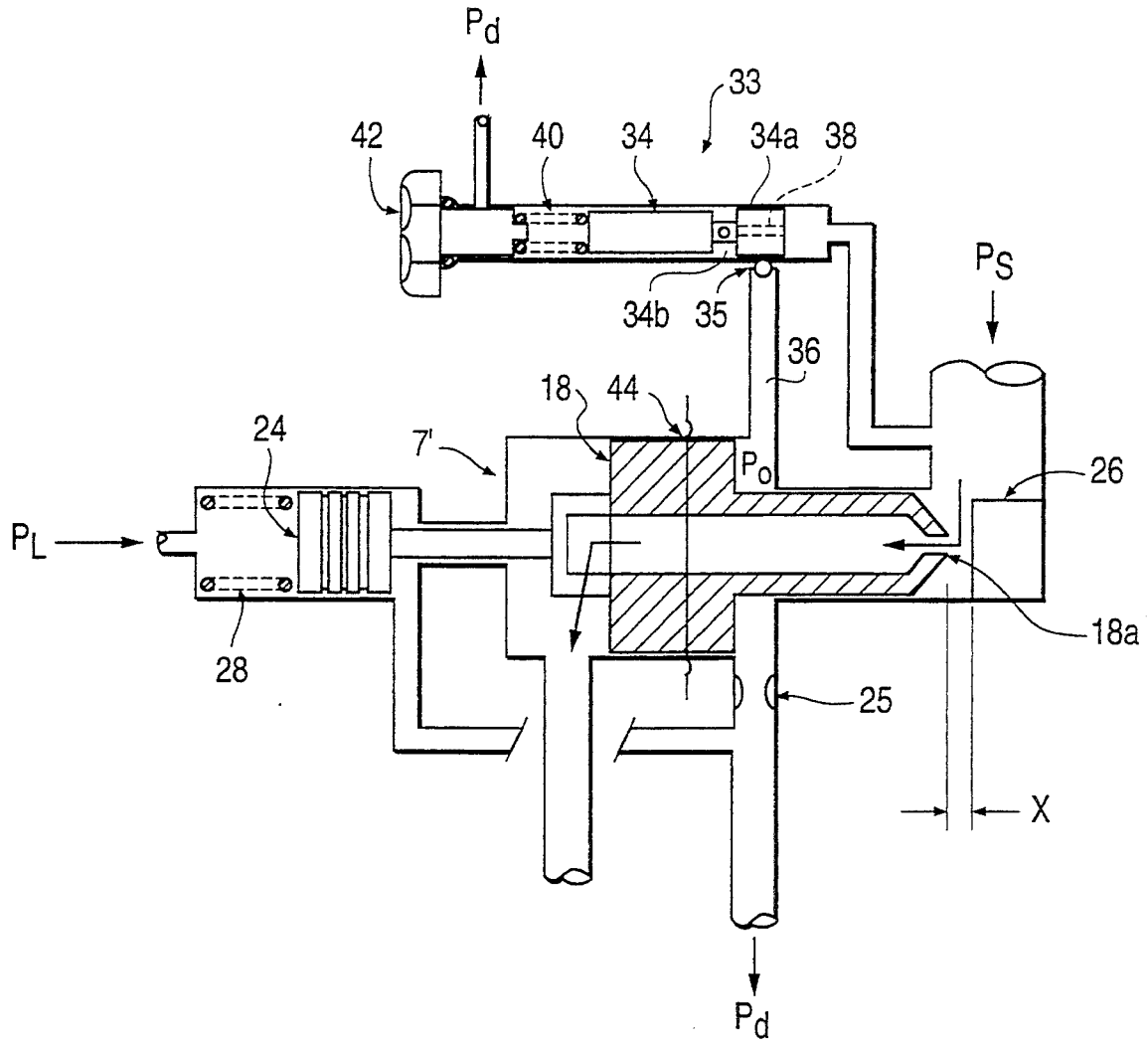
FIG. 4 is a view corresponding to that of FIG. 3 but of a modified embodiment of the timing control valve.

In particular, in addition to the features of the first embodiment, described above and which bear the same reference numerals in FIG. 4, with prime (') designations indicating elements which have been modified in some respect, a variable orifice arrangement 33 is provided for varying the pressure $P_o$ that acts on the timing plunger 18 to a value that can be anywhere between the pressure $P_d$ and the pressure $P_s$.

The variable orifice arrangement 33 comprises a control orifice 35 which is opened and closed by a control plunger 34. Control orifice 35 is arranged in series with orifice 25, which serves as a reference with respect to the variable control orifice 35, and thus, is not optional in this embodiment as it is in the embodiment of FIGS. 1–3. By varying the flow coefficient $F_c$ through control orifice 35, via displacement of the control plunger 34, the pressure $P_o$ in the space 36, between control orifice 35 and reference orifice 25, can be made to achieve any desired values between the speed-responsive pump pressure $P_s$ and the drain pressure $P_d$. In particular, control plunger 34 has a land 34a which defines two metering edges, one at each end of the land. Both ends of land 34a are exposed equally to the pump pressure $P_s$, with one side of land 34a being exposed directly to flow from the pump P and the other side being connected thereto via a passage 38 which extends through land 34a to an annulus 34b. A reference spring 40 moves plunger 34 to the fight relative to its position in FIG. 4 when pump pressure $P_s$ is low, thereby partially opening orifice 35 at the left side of the land. Thus, at engine idle speed (e.g., 700 to 800 rpm), when pump pressure is around, for example, 90 psi, the position of the control plunger would be calibrated (or adjusted by an adjustment knob 42 which acts on an end of reference spring 40) to produce the proper flow coefficient $F_c$ for achieving, together with the flow coefficient $F_r$ of the reference orifice 25, the appropriate modification of the ratio dictated by timing plunger 18 in accordance with the relationships:

$$P_o = P_s/(1+(F_r/F_c)^2) \text{ and}$$

$$P_t = KP_s + kP_o$$

where k is an empirically determined ratio between the exposed areas of the ends of land 34a.

Figure 5:
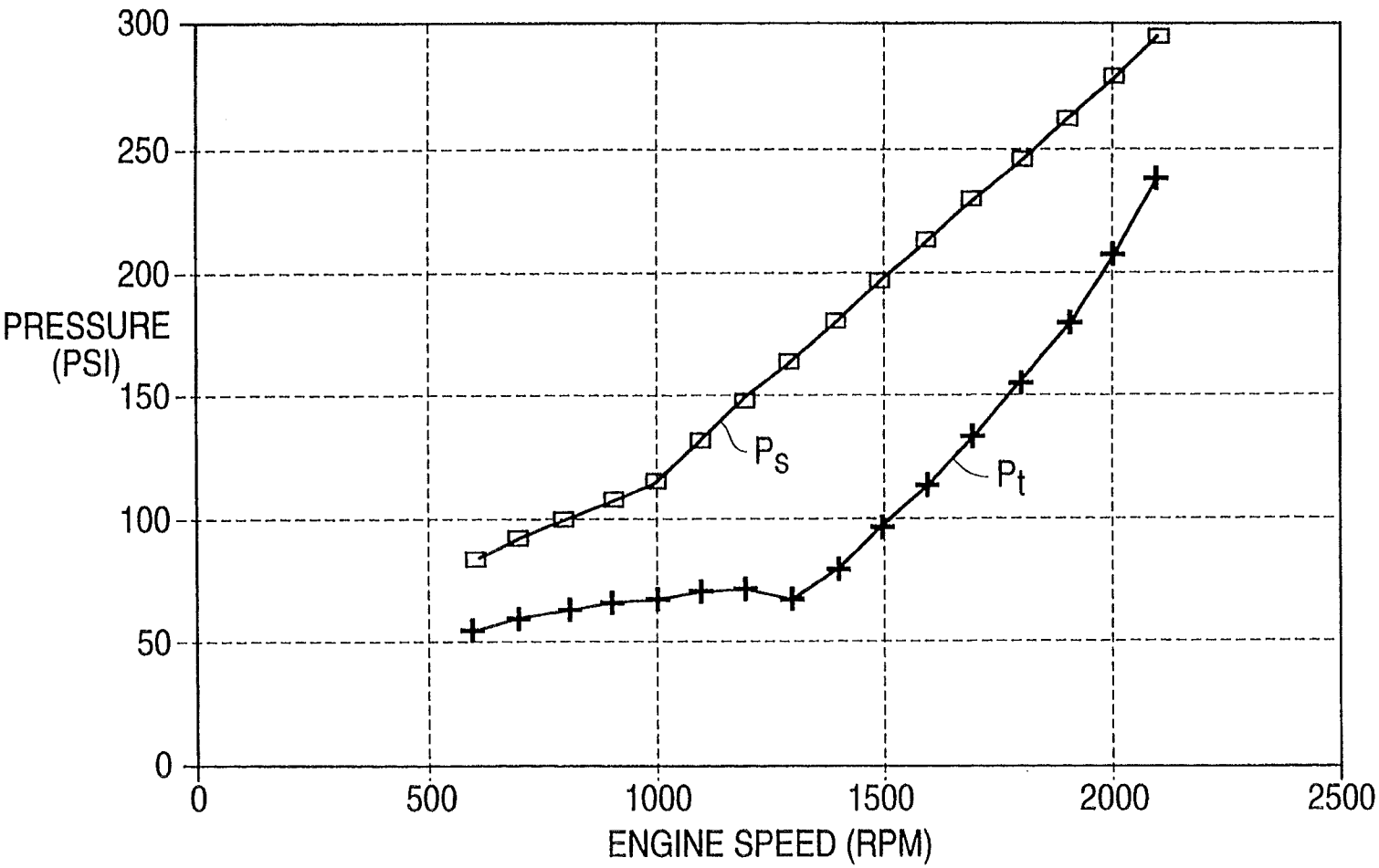
FIG. 5 is graph depicting an example of no-load pump pressure and timing pressure as a function of engine speed.
Figure 6:
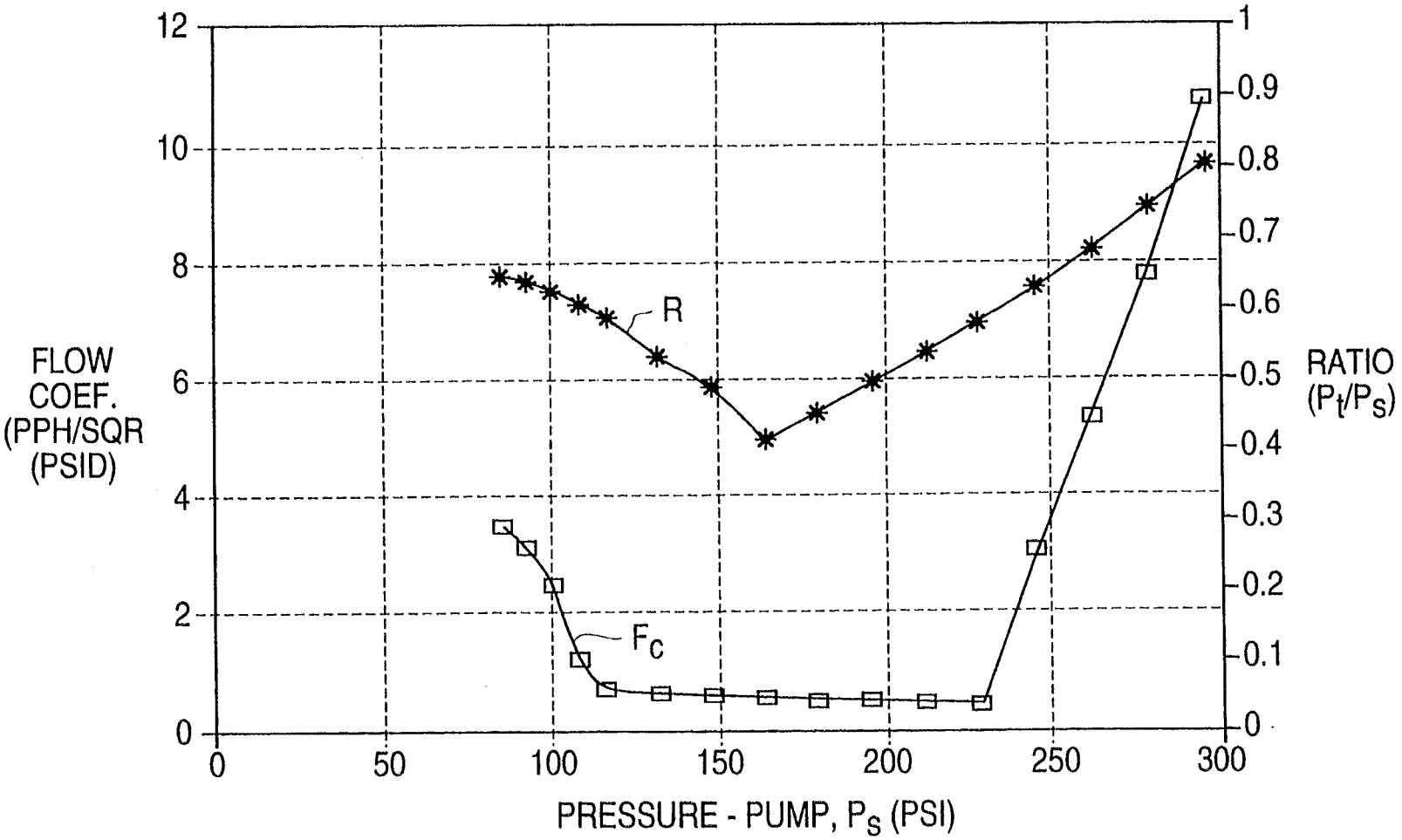
FIG. 6 depicts the ratio of the pressures shown in FIG. 5 and the flow coefficients of the control valve required to produce these pressure ratios.

In this regard, FIG. 5 shows a plot of pressures $P_s$ and $P_t$ that were obtained from measurements of a particular engine operating under no load conditions and from which the ratio R therebetween (shown in FIG. 6) can be derived. FIG. 6 also shows the values of $F_c$ necessary to produce a corresponding variation in the ratio R. With regard to the illustrated values of $F_c$, the decreasing value thereof is produced as the control plunger 34 moves (leftward from its initial position toward its illustrated position in FIG. 4) closing control orifice 35. The essentially constant value of $F_c$ occurs while the control orifice 35 is completely closed and the timing control valve 7' functions in the manner of constant ratio timing control valve 7 of FIGS. 1–3, and the rising values of $F_c$ (shown at the right in FIG. 6) are produced as control orifice 35 is reopened, which occurs as the right end of control plunger 34 moves across the control orifice 35 (to the left in FIG. 4).

The control valve 7', as described above will be able to serve any particular family of engines (i.e., 6, 8 . . . , 16 cylinder engines of the same design), and by way of example only, for Cummins Engine Co. K-series engines, values for K of 0.6, k of 0.4, $F_r$ of 10, have been found suitable along with a diameter of 0.035 for the orifice 18a in the end of the timing plunger 18. Furthermore, by maintaining a small stock of control plungers 34 and reference springs 40, as a family of parts that can be selected as appropriate to meet various calibration needs of a particular application, a single timing valve arrangement according the invention will be able to address a wide range of engine types and ratings.

FIG. 4 also illustrates a modification that is equally applicable to the embodiment of FIGS. 1–3. In particular, the timing plunger 18 is attached to a diaphragm seal 44 which is connected, in turn, to housing 22. The provision of such a diaphragm arrangement avoids the need for closely matching the outer diameter of timing plunger 18 to the inner diameter of the bore of housing 22 in which it slides and also cuts down on leakage of fluid between timing plunger 18 and housing 22. On the other hand, the provision of such a diaphragm arrangement may prove more costly and is a potential failure site, so that the use thereof should be viewed as purely optional, even in the FIG. 4 embodiment in which it is shown.

While various embodiments in accordance with the present invention have been shown and described, it is understood that the invention is not limited thereto, and is susceptible to numerous changes and modifications as known to those skilled in the art. For example, while a single reference spring 40 is shown in the FIG. 4 embodiment, it is contemplated that two springs of different rates and/or lengths could be used, one at each end of control plunger 34, so that movement of the control plunger 34 is dictated by the net spring rate of both springs. Likewise, while the end of plunger 18 having orifice opening 18*a* is shown as conically shaped in both embodiments and such is advantageous from a flow streamlining standpoint, that end of plunger 18 could be made flat. Furthermore, those skilled in the art would recognize, from the above, how timing control valves as disclosed in the above-referenced commonly owned, U.S. patent application Ser. No. 08/007,973 could be adapted for use in place of the variable orifice arrangement 35 for producing the described variable flow coefficient $F_c$ for flow to space 36. Therefore, this invention is not limited to the details shown and described herein, and includes all such changes and modifications as are encompassed by the scope of the appended claims.

Industrial Applicability

The present invention will find applicability in a wide range of fuel injection systems for internal combustion engines, particularly diesel engines. The invention will be especially useful where precision timing is essential and/or it is desired to use a hydromechanical control system instead of an electronic one, and particularly where it is desired to have a timing control valve that will address the needs of a wide range of engine types and ratings.

We claim:

1. In a fuel supply system for an internal combustion engine of the type wherein a supply pump supplies fuel to fuel injectors at a pressure that is controlled in accordance with engine operating conditions via a first supply rail and supplies timing fluid to the fuel injectors via a second supply rail, an infinitely variable hydromechanical timing valve comprising a housing having a valve seat therein, and a timing control plunger mounted for reciprocation within said housing toward and away from said valve seat; wherein a first side of the timing control plunger is acted upon by a pressure which varies as a function of engine speed; wherein a second side of the timing control plunger is acted upon by a pressure which varies as a function of engine load; wherein the timing control plunger has an orificed timing flow passage therethrough, one end of said timing flow passage being in communication with a timing flow of fuel from said pump and an opposite end of said tinting flow passage communicating with said second supply rail; and wherein a variable flow area is defined by a circumference of the orifice of the orificed flow passage through the timing control plunger and the distance of the orifice from said valve seat as a means for controlling the pressure of the timing flow communicated to said second supply rail by a throttling of the timing flow from the pump in a manner which is a function of the pressures acting on the timing control plunger.

2. A fuel supply system according to claim 1, wherein a rail plunger is mounted for reciprocation in said housing, one end of said rail plunger being acted upon by the pressure which varies as a function of engine load and an opposite end of the rail plunger being engageable with an abutment at said first side of the timing control plunger.

3. A fuel supply system according to claim 2, wherein an intermediate portion of each of said plungers is connected to a drain passage.

4. A fuel supply system according to claim 3, wherein said drain passage is provided with a drain orifice for limiting the rate at which fuel is able to drain from the drain passage.

5. A fuel supply system according to claim 4, wherein the intermediate portion of said timing control plunger is exposed within an intermediate space of the housing that is connected to the drain passage upstream of said drain orifice; wherein the intermediate space is also connected to a variable orifice arrangement; wherein the intermediate portion of said second plunger is connected to the drain passage downstream of said drain orifice; and wherein said variable orifice arrangement is connected to the timing flow of fuel from said pump upstream of said timing control plunger and said valve seat, whereby said variable orifice arrangement forms a means for controllably varying the pressure in said intermediate space by controlling the admission of fuel from the timing flow into the intermediate space.

6. A fuel supply system according to claim 5, wherein said variable orifice arrangement comprises a control orifice communicating with said intermediate space, and a second control plunger mounted for reciprocation across the control orifice in a :manner varying the flow coefficient of the control orifice; wherein said second control plunger is displaceable as a function of the timing flow of fuel from said pump.

7. A fuel supply system according to claim 6, wherein a first end of said second control plunger is exposed to the pressure of the timing flow of fuel from said pump; and wherein a reference spring acts on a second end of the second control plunger applying a pressure thereto in opposition to the pressure of the timing flow of fuel from said pump.

8. A fuel supply system according to claim 7, wherein adjustment means is provided for adjusting the pressure applied by said reference spring to the second control plunger.

9. A fuel supply system according to claim 7, wherein said second control plunger has an annulus forming a land at the first end of said second control plunger, and wherein a passage is formed in said second control plunger which extends from said first end of the second control plunger to said annulus.

10. A fuel supply system according to claim 1, wherein the orifice of the orificed flow passage of said timing control plunger is formed at said first side of the timing control plunger in a conically shaped end thereof.

11. A fuel supply system according to claim 1, wherein the circumference, C, of the orifice of the timing control plunger is set in accordance with the relationships:

$$C = Q_{max}/x_{max}G\sqrt{\Delta P} \text{ and } x_{max} \leqq C/S\pi$$

where $x_{max}$ is a predetermined maximum spacing of the orifice of the timing control plunger, Qmax is a maximum quantity of timing fluid which the control valve must be able to deliver, where G is a coefficient which combines empirically determined constants including the specific gravity of the fluid and the coefficient of discharge through the orifice of the timing control plunger, where ΔP is an expected pressure drop through the orifice of the timing control plunger, and where S is a control factor for improving response linearity.

12. A fuel supply system according to claim 4, wherein the first and second sides of the timing control plunger have different areas in accordance with the relationship:

$$P_t = P_d + K(P_s - P_L)$$

where $P_t$ is the pressure of the timing flow communicated to said second supply rail, $P_s$ is the pressure which varies as a function of engine speed acting on the first side of the timing control plunger, $P_L$ the pressure which varies as a function of engine load acting on the second side of the timing control plunger, $P_d$ is a pressure produced by fuel draining through the drain orifice on the intermediate portion of the timing control plunger, and K is a ratio of an area of the second side of the timing control plunger on which pressure $P_L$ acts relative to an area of the first side of the timing control plunger on which pressure $P_s$ acts.

13. A fuel supply system according to claim 12, wherein the circumference, C, of the orifice of the timing control plunger is set in accordance with the relationships:

$$C = Q_{max}/x_{max}G\sqrt{\Delta P} \text{ and } x_{max} \leqq C/S\pi$$

where $x_{max}$ is a predetermined maximum spacing of the orifice of the timing control plunger, Qmax is a maximum quantity of timing fluid which the control valve must be able to deliver, where G is a coefficient which combines empirically determined constants including the specific gravity of the fluid and the coefficient of discharge through the orifice of the timing control plunger, where ΔP is an expected pressure drop through the orifice of the timing control plunger, and where S is a control factor for improving response linearity.

14. A fuel supply system according to claim 9, wherein the first and second sides of the timing control plunger have different areas in accordance with the relationship:

$$P_t = P_d + K(P_s - P_L)$$

where $P_t$ is the pressure of the timing flow communicated to said second supply rail, $P_s$ is the pressure which varies as a function of engine speed acting on the first side of the timing control plunger, $P_L$ the pressure which varies as a function of engine load acting on the second side of the timing control plunger, $P_d$ is a pressure produced by fuel draining through the drain orifice on the intermediate portion of the timing control plunger, and K is a ratio of an area of the second side of the timing control plunger on which pressure $P_L$ acts relative to an area of the first side of the timing control plunger on which pressure $P_s$ acts; and wherein exposed areas of the ends of said land of the second control plunger, the control orifice, and the drain orifice are sized to produce flow coefficients, $F_c$, through the control orifice in accordance with the relationships:

$$P_o = P_s/(1+(F_r/F_c)^2) \text{ and}$$

$$P_t = KP_s + kP_o$$

where $P_o$ is the pressure in said intermediate space which acts on the intermediate portion of the timing control plunger, k is a predetermined ratio between exposed areas of the ends of said land, and $F_r$ is a flow coefficient of the drain orifice.

15. A fuel supply system according to claim 14, wherein the circumference, C, of the orifice of the timing control plunger is set in accordance with the relationships:

$$C = Q_{max}/x_{max}G\sqrt{\Delta P} \text{ and } x_{max} \leqq C/S\pi$$

where $x_{max}$ is a predetermined maximum spacing of the orifice of the timing control plunger, Qmax is a maximum quantity of timing fluid which the control valve must be able to deliver, where G is a coefficient which combines empirically determined constants including the specific gravity of the fluid and the coefficient of discharge through the orifice of the timing control plunger, where ΔP is an expected pressure drop through the orifice of the timing control plunger, and where S is a control factor for improving response linearity.

16. A fuel supply system according to claim 5, wherein the timing control plunger is connected to the housing by a diaphragm seal at a location between the intermediate portion and the second end of the timing control plunger.

17. A fuel supply system according to claim 7, wherein a plurality of different interchangeable control plungers and a plurality of different interchangeable reference springs are provided as a means for enabling the fuel system to be adapted to meet calibration needs of different engine applications.

* * * * *